United States Patent [19]

Kaylor et al.

[11] 4,207,562

[45] Jun. 10, 1980

[54] APPARATUS FOR DETERMINING OPTIMUM HAY BALING CONDITIONS

[75] Inventors: Buford Kaylor, Klamath Falls, Oreg.; Wilford M. Kaylor, Sebastopol, Calif.

[73] Assignee: Kaylor AG Products, Inc., Klamath Falls, Oreg.

[21] Appl. No.: 907,971

[22] Filed: May 22, 1978

[51] Int. Cl.[2] ..... G08B 21/00

[52] U.S. Cl. ..... 340/602; 200/61.06

[58] Field of Search ..... 340/602, 604, 601; 200/61.04, 61.05, 61.06

[56] References Cited

U.S. PATENT DOCUMENTS

| | | | |
|---|---|---|---|
| 1,706,850 | 3/1929 | Hingsburg | 340/602 X |
| 1,730,080 | 10/1929 | Luckey | 340/602 X |
| 1,995,430 | 3/1935 | Lewis | 200/61.06 |
| 2,190,549 | 2/1940 | Schoew | 200/61.06 |

*Primary Examiner*—John W. Caldwell, Sr.
*Assistant Examiner*—Daniel Myer
*Attorney, Agent, or Firm*—Fulwider, Patton, Riber, Lee & Utecht

[57] ABSTRACT

An alarm device for indicating the optimum humidity conditions for baling of hay is disclosed which comprises a humidity sensing device with its normally closed switch in circuit between an electrical power source and an audible alarm. The device is mounted at a location where it is responsive to the ambient atmospheric, i.e., outside, air humidity and is set to trigger the alarm when the air humidity reaches a value of at least about 55 percent. This indicates an optimum condition for baling since at this outside humidity the hay absorbs sufficient moisture that it is not defoliated when baled.

2 Claims, 4 Drawing Figures

APPARATUS FOR DETERMINING OPTIMUM HAY BALING CONDITIONS

BACKGROUND OF THE INVENTION

This invention relates to an alarm device and, in particular to an alarm particularly useful for indicating optimum humidity conditions for hay baling.

BRIEF STATEMENT OF THE PRIOR ART

Baling of hay such as alfalfa requires that the hay be above a minimum moisture content to avoid excessive crumbling and chaffing. When the hay has been cut and dried in the field, it lacks sufficient moisture during day time hours and baling can only be conducted at night when there is adequate humidity and condensation of dew on the hay.

The condensation of dew and absorption of moisture by the hay follows a predictable pattern with the relative humidity of the air and hay producers have monitored the evening and night humidities to determine when the hay has reached its optimum moisture content for baling operations. Since the humidity changes do not follow a precisely predictable pattern, this practice necessitates frequent interruption of one's sleep and a continuous monitoring means with a suitable alarm that automatically is activated when optimum humidity conditions are achieved is desirable.

BRIEF DESCRIPTION OF THE INVENTION

The invention comprises the combination of a humidity sensing device having a normally open electrical switch that is placed in circuit between an electrical power source and an electrical alarm. The dehumidifier control preferably has an adjustable setting whereby the humidity level required for closing of the normally open switch contacts is fixedly adjustable. The device also includes mounting for the humidity sensing device in exposure to outside or ambient air so that the sensing device accurately responds to changes in humidity of the outside, nighttime air.

BRIEF DESCRIPTION OF THE DRAWINGS

The invention will be described with reference to the FIGURES of which.

BRIEF DESCRIPTION OF THE PREFERRED EMBODIMENTS

Figure 1:
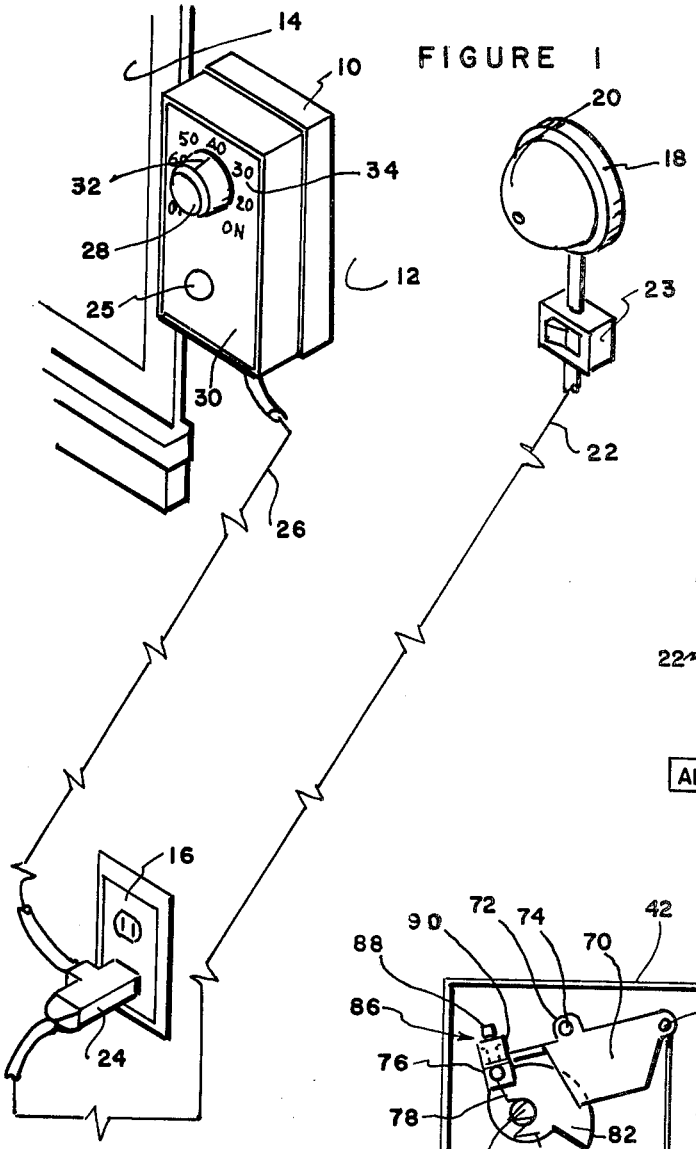
FIG. 1 is a perspective view of a suitable installation of the invention.
Figure 4:
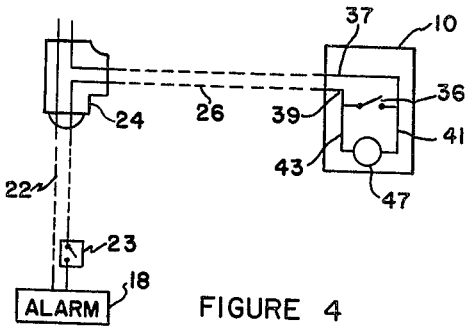
FIG. 4 is an electrical schematic of the invention.

Referring now to FIG. 1, the invention is shown as comprising a humidity sensing device 10 that is mounted on a support such as wall 12 where it is exposed to outside, ambient air and is responsive to the humidity of the outside air. If the controller 10 is mounted on an inside wall, it is preferably mounted adjacent an open window 14 providing for free circulation of outside air past the sensing device 10. Alternatively, the sensing device 10 can be mounted on an outside wall.

The sensing device 10 is placed in circuit between a source of electrical power such as a conventional electrical outlet box 16 provided with a source of alternating current electrical power of conventional voltage, e.g., 115 volts. Alternatively, the sensing device could be placed in circuit with a direct current voltage supply from a storage battery, of the dry cell or rechargeable wet cell such as a conventional vehicle battery and the like.

Also placed in the circuit is an audible alarm 18 which can comprise a bell-type alarm having a bell 20 and an internal striker with power means electrically driven and connected to the power source by a suitable electrical cord conductor 22. The cord conductor is connected through a conventional plug received within the prong sockets of connector plug 24. The latter has one of the pair of electrical cconductors connected through electrical cord 26 to the normally open electrical switch of the controller 10.

The preferred embodiment can include a switch 23 which can be located adjacent the alarm 18, as shown, or can be in cord 22 or 26 or in the sensing device 10. The switch is used to open the circuit after the alarm has sounded or to deactivate the entire unit.

The humidity sensing device and the electrical connector plug 24 and cord 26 are commercially available as a dehumidifier controller, model H46E from the Honeywell Corporation, Minneapolis, Minnesota. This controller has a normally open switch having a spring-biased operator mechanically coupled by a lever to a band of material which exhibits dimensional contraction upon an increase in humidity.

The sensing device can be modified to include a light source 25 which indicates that the system is in an activated or stand-by condition. Alternatively, the light could be placed elsewhere in the circuit and even can be included in switch 23.

The humidity sensing device 10 has adustment means in the form of knob 28 mounted on front face 30 permitting the fixed adjustability in the humidity level required for closing of the normally open switch contacts. The knob 28 bears an index 32 which cooperates with indicia 34 to indicate the relative humidity at which the switch contacts will close.

Figure 2:
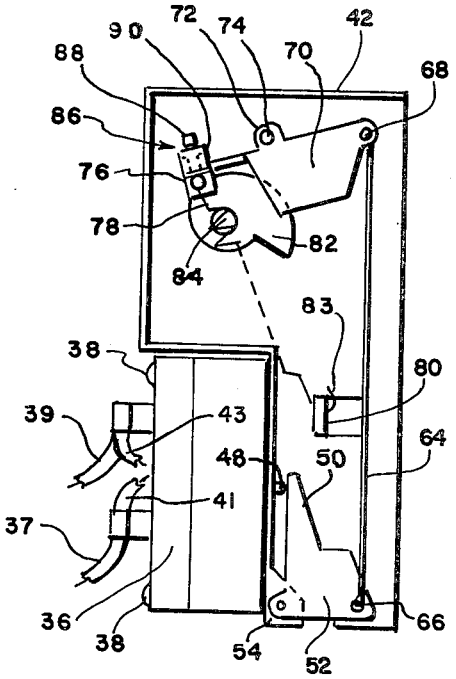
FIG. 2 is a sectional side elevational view of the humidity sensing device used in the invention.
Figure 3:
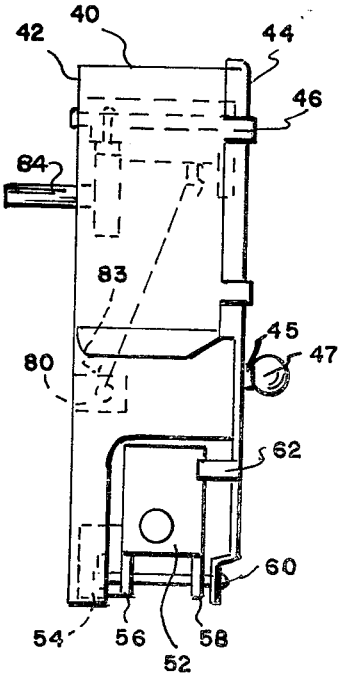
FIG. 3 is a view along lines 3—3 of FIG. 2.

Referring now to FIGS. 2 and 3, the structure and operation of the humidity sensing device will be described in greater detail. As there illustrated, the normally open switch comprises a microswitch 36 that is secured to the assembly by machine screws 38. The microswitch is connected to conductors 37 and 39 of electrical cord 26 and conductor 41 and 43 are extended to the light socket 45 which receives bulb 47 for indicator light source 25. The socket 45 and bulb 47 are shown in FIG. 3. The control assembly comprises a housing 40 that is formed of a box 42 with a coverplate 44 secured thereto be bent metal tabs 46. FIG. 2 illustrates the structure with coverplate 44 removed. As there illustrated, the operator 48 of microswitch 36 projects into the housing and abutts against arm 50 of lever 52 that is pivotally mounted to a bent metal bracket 54 of the housing. This lever 52 is shown in FIG. 3 to have opposite sidewalls 56 and 58 that receive pin 60. Coverplate 44 has a bent metal tab 62 that serves as a stop for the lever 52.

A band 64 of material dimensionally sensitive to humidity is attached with one end to lever 52, being looped about pin 66 carried by lever 52. The opposite end of band 64 is looped about pin 68 of lever 70. The latter has a tab 72 having a central aperture that receives pin 74 for pivotal mounting of lever 70 in the housing. A distal tab 76 also has an aperture and receives one end of helical tension coil spring 78, the opposite end 83 of which is secured to the housing by a bracket 80, thereby providing a predetermined tension to band 64.

A cam 82 is mounted in the housing on shaft 84, positioned with its peripheral cam edge bearing against a cam guide generally indicated at 86. Cam guide 86 comprises a pin 88 that is mounted in bracket 90 distally carried by lever 70. The pin 88 is factory adjusted to provide a preset cam guide bearing point between the peripheral edge of cam 82 and lever 70. The control knob 28 shown in FIG. 1 is mounted on shaft 84 to provide the predetermined tension tube band 64.

The structure thus described comprises an assembly of the electrical switch 36 having its switch operator 48 biased to a normally open switch position, a switch lever 50 operatively connected to band 64 of humidity sensitive material which is attached at its opposite end to an abuttment, lever 70. The lever abuttment 70 is adjustably mounted to provide a predetermined fixed adjustability in tension of band 64. From the construction, it can be seen that as the band dimensionally contracts with increasing humidity, switch lever 52 will be urged against switch operator 48, closing the contacts of electrical switch 36.

The device can be set to any predetermined triggering value of relative humidity for alerting a hay producer of the proper conditions for baling of hay. Generally, the triggering value will be set from 55 to about 75 percent relative humidity which experience has shown to be approximately the optimum value for commencing baling operations. The exact value can be determined for the intended location of use and season upon use of the alarm. The dehumidifier controller 10 can be located at any point remote from the remainder of the assembly including the alarm 18 and the source of electrical power, outlet box 16. This is desirable since the humidity sensing device can, preferably, be located on an outside wall or in a circulating stream of outside air so that it properly responds to the same humidity conditions surrounding the hay.

The assembly can also be modified to use low voltage, e.g., 6 to 24 volt components by incorporating a simple step down voltage transformer.

The invention has been described with reference to the illustrated and presently preferred embodiments. It is not intended that the invention be limited to the illustrated and presently preferred embodiments. Instead, the invention is intended to be defined by the means and their obvious equivalents, set forth in the following claims.

What is claimed is:

1. A device to indicate proper conditions for baling hay which comprises:

(a) a humidity sensing device comprising an electrical switch with a switch operator biased to a normally open position, a switch lever, a band of humidity sensitive material that dimensionally contracts upon increasing humidity attached at one end to an abuttment and at the other end to said lever to urge said lever against said switch operator, and fixed adjustment means to control the tension on said band sufficient to close said switch at a relative himidity from 55 to 75 percent;

(b) electrically responsive audible alarm means;

(c) electrical power means;

(d) a pair of electrical conductor means connecting in circuit said power means, switch means and alarm means and a second pair of electrical conductor means connecting in circuit said power means and said light means; and (e) support means having mounted thereon said sensing device in a location responsive to ambient, outside air humidity.

2. The device of claim 1 including means to circulate a stream of ambient air past said sensing device.

* * * * *